US005721403A

United States Patent [19]

Hoppie et al.

[11] Patent Number: 5,721,403

[45] Date of Patent: Feb. 24, 1998

[54] SELECTIVE CIRCUIT BYPASS FOR ELEVATOR SYSTEM

[75] Inventors: Paul C. Hoppie; Richard G. Smith, both of Bloomington, Ind.

[73] Assignee: Otis Elevator Company, Farmington, Conn.

[21] Appl. No.: 625,660

[22] Filed: Mar. 29, 1996

[51] Int. Cl.[6] ..... B66B 1/34

[52] U.S. Cl. ..... 187/391; 187/247; 187/413; 187/277

[58] Field of Search ..... 187/277, 280, 187/298, 247, 413, 391

[56] References Cited

U.S. PATENT DOCUMENTS

| | | | |
|---|---|---|---|
| 2,094,047 | 9/1937 | Smart | 187/29 |
| 4,128,143 | 12/1978 | Petterson et al. | 187/29 R |
| 4,497,391 | 2/1985 | Mendelsohn et al. | 187/29 R |
| 4,674,604 | 6/1987 | Williams | 187/113 |
| 4,750,591 | 6/1988 | Coste et al. | 187/130 |
| 4,755,091 | 7/1988 | Potucek et al. | 411/452 |
| 4,964,804 | 10/1990 | Carr et al. | 434/219 |
| 5,107,964 | 4/1992 | Coste et al. | 187/104 |
| 5,202,540 | 4/1993 | Auer et al. | 187/101 |
| 5,321,216 | 6/1994 | Jamieson et al. | 187/105 |
| 5,407,028 | 4/1995 | Jamieson et al. | 187/288 |

OTHER PUBLICATIONS

American National Standard Saftey Code for Elevators, Dumbwaiters, Escalators and Moving Walks, ANSI A17.1–1978, Dec. 1979.

*Primary Examiner*—Robert Nappi

[57] ABSTRACT

An electrical branch bypass arrangement includes a first branch, a second branch and means for opening the first branch and for bypassing the second branch. Preferably, the means includes a plurality of plugs mechanically bundled together so that each of the plugs is spatially fixed with respect to one another and all of the plugs are movable as a unit.

5 Claims, 5 Drawing Sheets

FIG.5

| | |
|---|---|
| CIS | CONTROLLER INSPECTION SWITCH |
| CIO | CHECK INPUT OUTPUT RELAY |
| INA | INSPECTION RELAY |
| TA32 | FIELD TERMINATION |
| TOP OF CAR | SAFETY CONTACTS (SWITCHES)LOCATED ON THE CAR TOP |
| K41 | FIELD TERMINATION |
| TA33 | FIELD TERMINATION |
| MA7 | FIELD TERMINATION |
| GOV'S | CAR AND COUNTERWEIGHT OVERSPEED GOVERNORS |
| MA21 | FIELD TERMINATION |
| HA26 | FIELD TERMINATION |
| LIMITS | TOP AND BOTTOM HOISTWAY FINAL LIMITS |
| HA28 | FIELD TERMINATION |
| PIT SW. | SAFETY CONTACTS (SWITCHES) LOCATED IN THE PIT |
| HA24 | FIELD TERMINATION |
| GS | FIELD TERMINATION |
| K37 | FIELD TERMINATION |
| GS | FRONT GATE SWITCH |
| TA11 | FIELD TERMINATION |
| DC | FIELD TERMINATION |
| DS | FRONT DOOR LOCK CONTACTS |
| DC1 | FIELD TERMINATION |
| FGDS | FRONT DOOR AND GATE SWITCH RELAY |
| K39 | FIELD TERMINATION |
| RGS | REAR GATE SWITCH |
| TB18 | FIELD TERMINATION |
| RDC | FIELD TERMINATION |
| RDS | REAR DOOR LOCK CONTACTS |
| RDC1 | FIELD TERMINATION |
| AGDS | ALTERNATE / REAR DOOR AND GATE SWITCH RELAY |
| J1-7 | MAINTENANCE SAFETY PANEL SOCKET |
| J2-9 | MAINTENANCE SAFETY PANEL SOCKET |
| J3-7 | MAINTENANCE SAFETY PANEL SOCKET |
| J4-11 | MAINTENANCE SAFETY PANEL SOCKET |
| J5-1 | MAINTENANCE SAFETY PANEL SOCKET |
| J6-3 | MAINTENANCE SAFETY PANEL SOCKET |
| J7-3 | MAINTENANCE SAFETY PANEL SOCKET |
| J8-5 | MAINTENANCE SAFETY PANEL SOCKET |
| J9-5 | MAINTENANCE SAFETY PANEL SOCKET |
| PX-1-11 | MAINTENANCE SAFETY PANEL PLUG |

SELECTIVE CIRCUIT BYPASS FOR ELEVATOR SYSTEM

BACKGROUND OF THE INVENTION

1. Technical Field

The present invention relates to electrical circuits, more particularly to electrical safety circuits useful in elevator systems.

2. Description Of The Prior Art

Elevator systems typically include electronic/electrical safety circuits such as electronic safety chains which disable normal elevator operation when any portion of the safety circuits is electrically open. See, for example, U.S. Pat. Nos. 5,202,540; 4,497,391; 4,964,804; 4,674,604; 5,407,028; 4,755,091; 5,107,964, and 5,321,216, which are all hereby incorporated in their entireties by reference. The '964 and '028 patents are particularly informative.

The present inventors believe that it is desirable to selectively bypass portions of a circuit such as an elevator safety circuit.

DISCLOSURE OF INVENTION

Accordingly, a branch bypass arrangement of the present invention includes a first electrically conductive branch, a second electrically conductive branch and means for opening the first branch and for electrically connecting to the second branch so that the second branch is bypassed electrically. Preferably, the branch bypass arrangement according to the present invention is connected to a controller including a CPU, a memory, buses, input/output ports, etc., and is also connected to a switch. The memory stores instructions which permit only inspection operation (at an inspection speed) of an elevator car if data received indicates that the first branch is opened and if the switch is, for example, closed. In a further preferred aspect, the instructions permit only inspection operation of the car if the first branch is opened, and if the switch is, e.g., closed, and if the second branch is electrically bypassed; thus, any safety components in the second branch do not affect elevator operation. In a still further preferred aspect, the instructions permit no operation of the elevator car if the first branch is opened and if the switch is, for example, open.

In the preferred embodiment, the means includes at least two connectors mechanically bundled together into a plug unit, but electrically insulated from one another, and connectors in at least two sockets or jacks for mechanically and electrically connecting/disconnecting with respective plugs. One plug when connected to one jack forms part of the first branch, while the other plug when connected to the other jack forms pan of a bypass branch connected so that the second branch is bypassed electrically. An important future of the invention is that the second branch can only be bypassed when this first branch is opened because of the mechanically bundled arrangement of the plugs within the plug unit, and the mechanically separated arrangement of the sockets or jacks. Preferably, the invention employs commercially available plugs, sockets (or jacks) and wires.

Elevator inspection speed can be enabled from an elevator machine room or from a top of car inspection box IB (FIG. 6), when a car inspection switch (for example CIS, on a car operating panel not shown) is in the appropriate position (for example, on). Upon recognizing a car inspection signal, conventional software instructions stored within the controller invoke any well-known inspection operation routines. Such routines are typically stored in the memory of the controller located in the machine room and cause an elevator motor to move the car C up/down at no greater than, for example, 140 feet per minute. While on inspection operation, the elevator car does not answer car/hall calls.

It is a principal object of the present invention to selectively bypass portions of an electronic circuit easily and reliably.

It is an additional object of the present invention to permit elevator service personnel to reliably and easily bypass portions of an elevator safety chain circuit.

It is a still further object of the present invention to disable normal elevator operation while any portion of an elevator safety chain circuit is bypassed.

It is a still additional object of the present invention to employ commercially available software to control elevator car motion while any portion of an elevator safety chain is bypassed.

Further and still other objects of the present invention will become more readily apparent when the following detailed description is taken in conjunction with the accompanying drawing, in which:

BRIEF DESCRIPTION OF THE DRAWING

FIG. 5 is a chart explaining the signals and contacts shown in FIG. 4.

DETAILED DESCRIPTION OF AND BEST MODE FOR CARRYING OUT THE INVENTION

Figure 1:
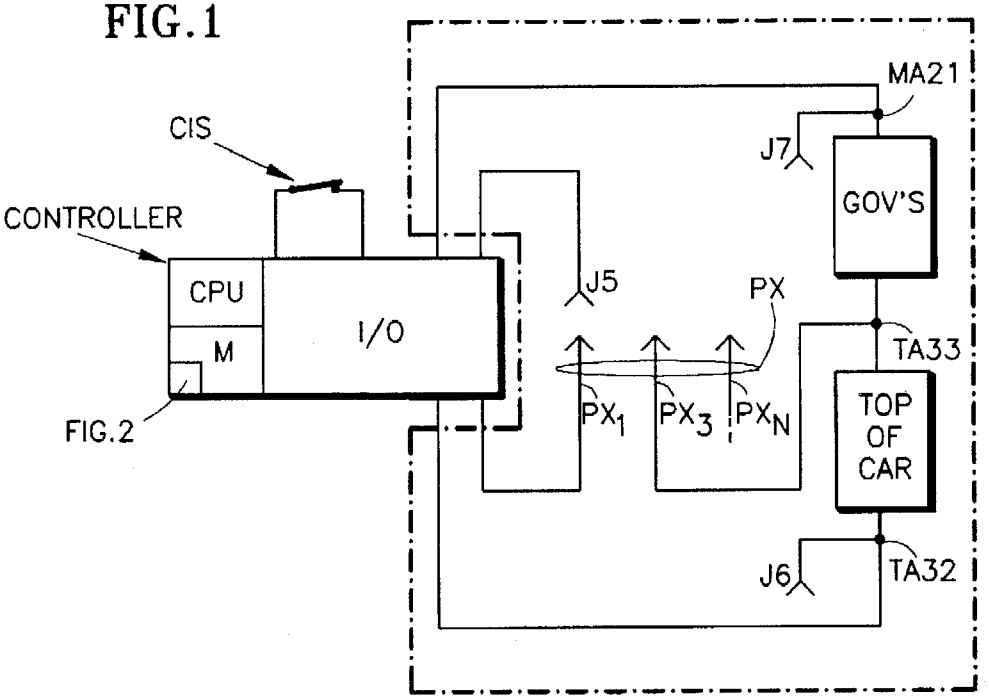
FIG. 1 is a block schematic circuit of the present invention 10 connected to a controller and to a switch (CIS).
Figure 3A:
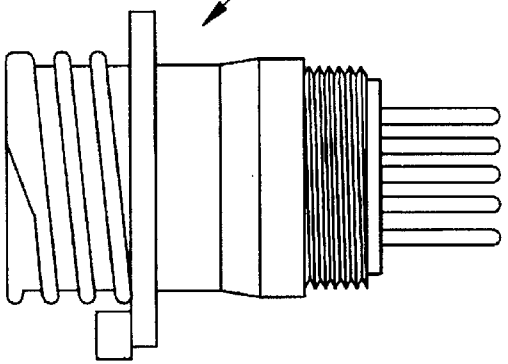
FIG.3A PRIOR ART
FIG. 3A is a side view of a preferred plug unit P which is commercially available.
Figure 3:
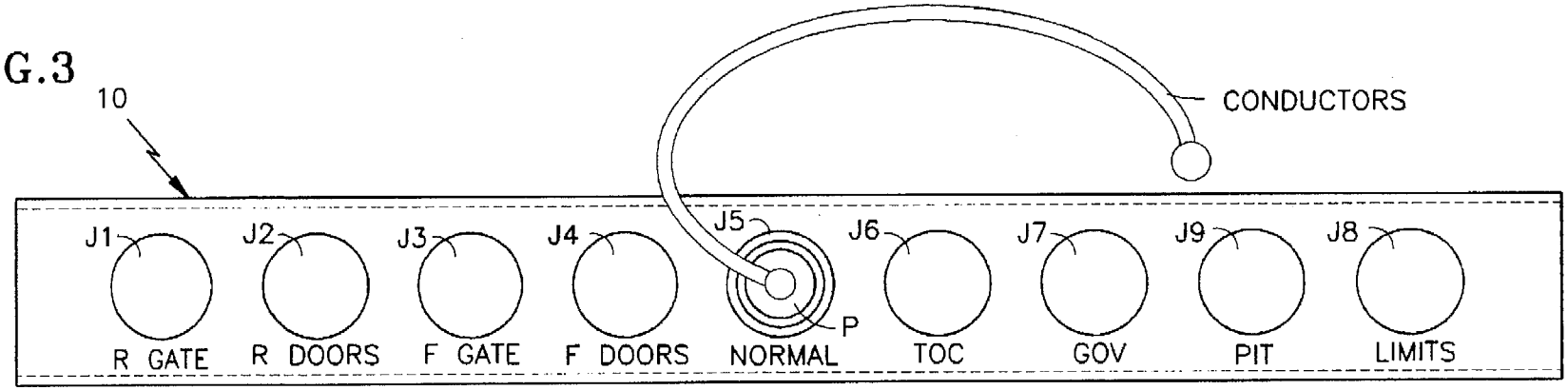
FIG. 3 is a front view of a panel/housing, a plug and jacks for the present invention, which is used by elevator service personnel in the machine room.
Figure 2:
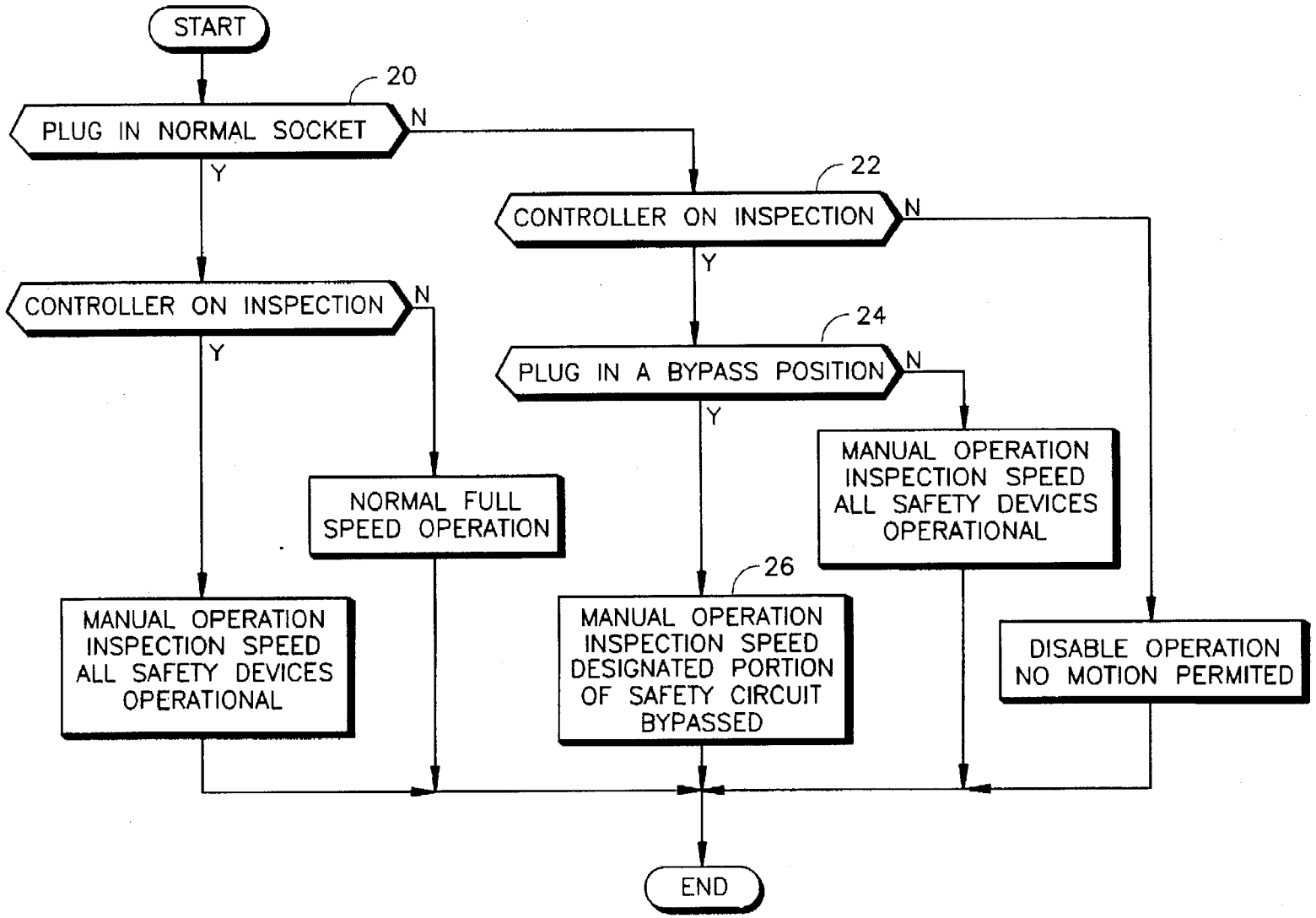
FIG. 2 is a high level flow chart for elevator operation according to preferred aspects of the present invention.

FIG. 1 is a schematic block diagram of a first preferred embodiment of the present invention 10 showing a plug unit P having a plurality of mechanically bundled connectors $Px_n$, and also having bypass jacks J, etc., connected to a controller and to portions of an elevator safety chain (branches TA32–TA33, TA33–MA21). For example, the plug P may be inserted into the jack J5 (i.e., pin or connector 1 of plug Px is inserted into connector 1 of a jack J5). Preferably, the elevator then operates on normal operation (See FIG. 2.). If Px is removed from J5, and then inserted into, for example, jack J6, a connector 3 of Px is mechanically constrained to insert into connector 3 of the jack J6. Thus, a top of car circuit (branch between node TA32 and node TA33, see FIGS. 1 and 4) is electrically bypassed or shunted. If the controller is on an inspection service (operation), the elevator will operate on inspection service with the particular safety circuit (e.g., top of car) bypassed.

Figure 4:
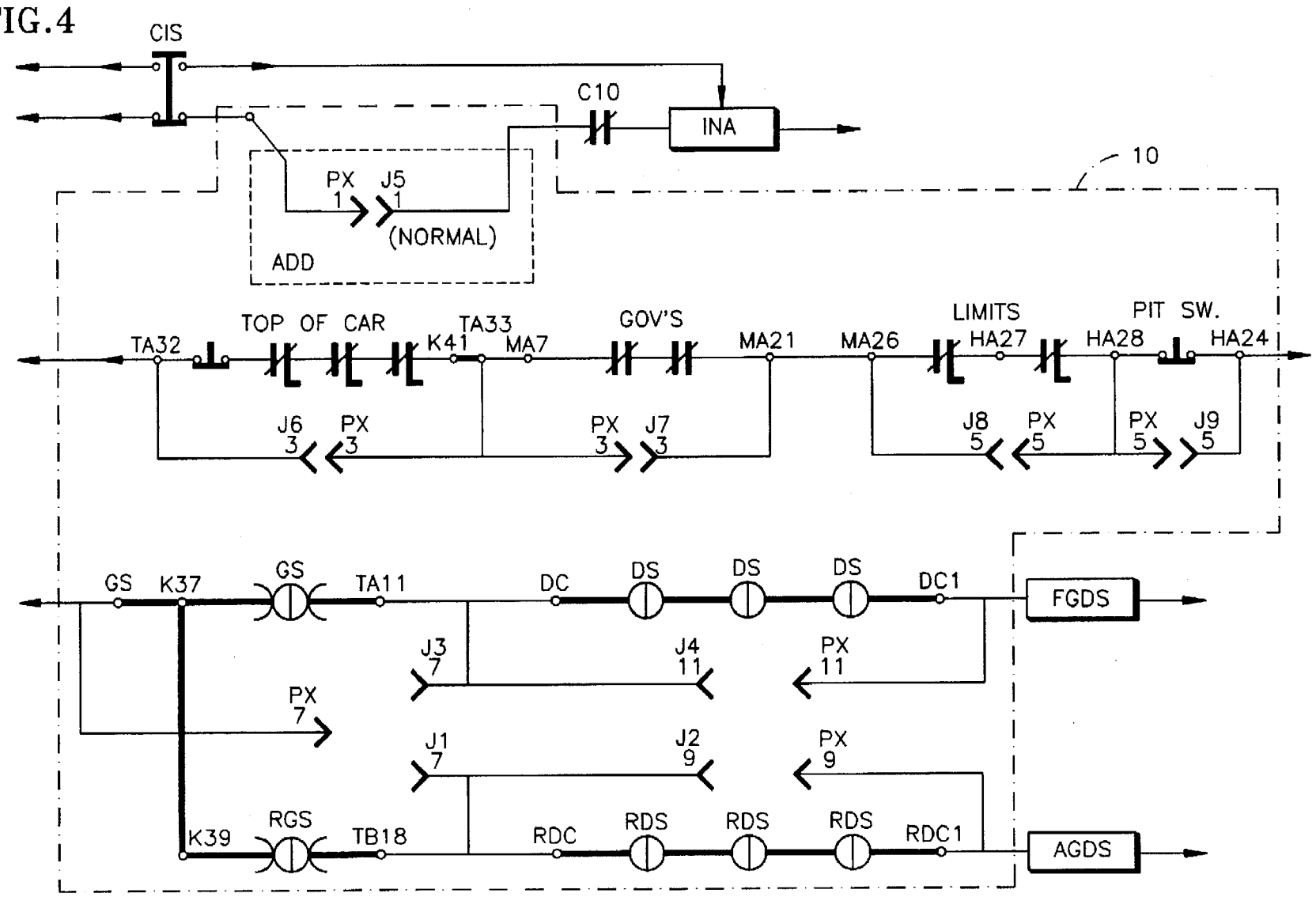
FIG. 4 is a more detailed schematic circuit diagram of one preferred embodiment of the branch bypass arrangement according to the present invention, used for an Elevonic® 411 elevator which is manufactured and marketed by Otis Elevator Company.

Preferably the arrangement according to the present invention selectively bypasses door or gate contacts or parts of the safety chain, for maintenance and troubleshooting purposes. Because all plugs Px are mechanically bundled together (although electrically insulated from each other), the present invention allows only one group of devices (e.g. the circuit branch between TA32 to TA33) to be bypassed at any one time, and disables all automatic elevator door operations when any of such circuits is bypassed. In FIG. 4, the invention is shown as applied to an Elevonic® 411 elevator system manufactured and sold by Otis Elevator Company. The various wires indicated by arrows are suitably connected to the controller or to other elevator circuit components in a manner that is well understood by those skilled in the art in view of the instant application.

Figure 6:
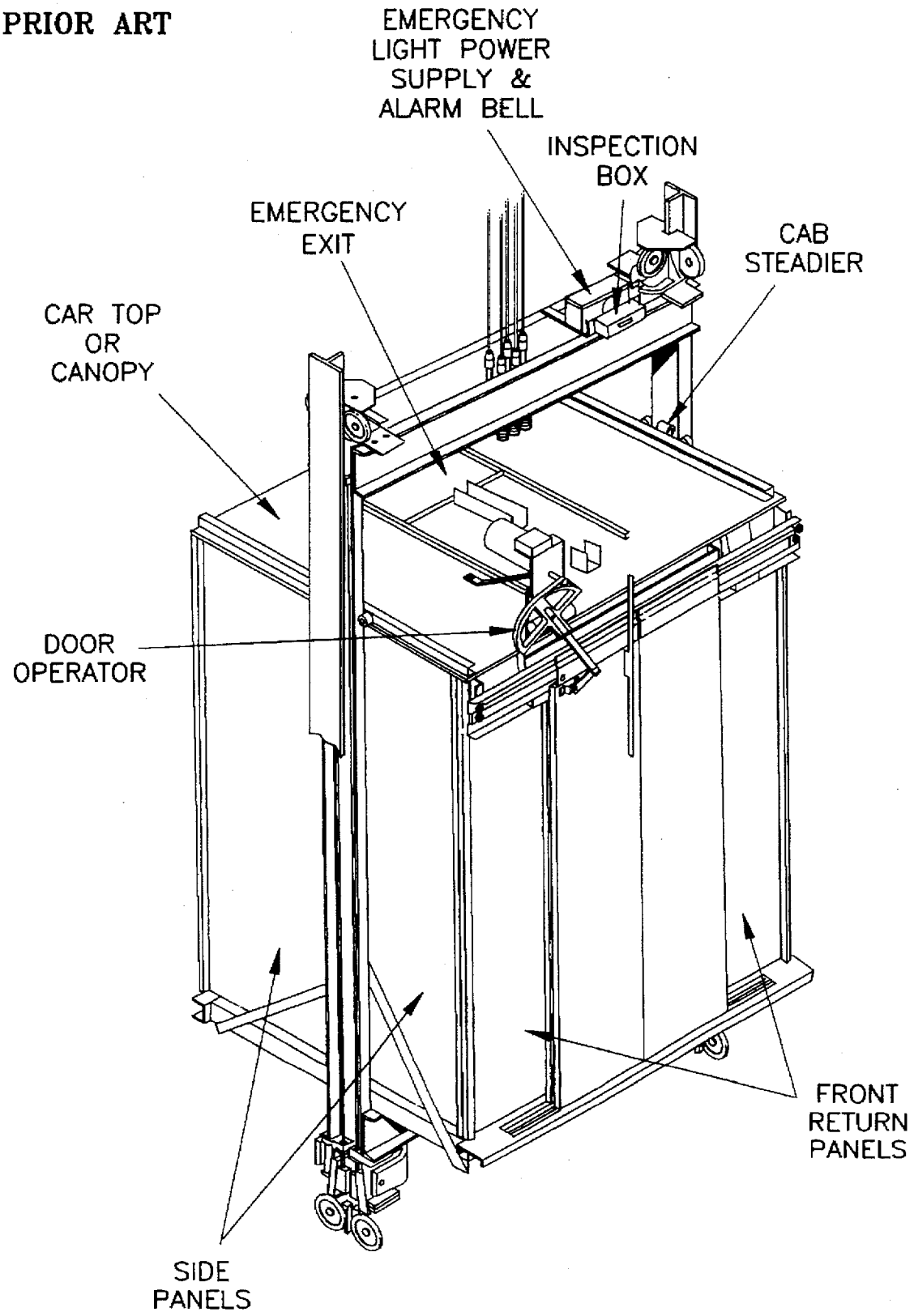
FIG.6 PRIOR ART
FIG. 6 is a perspective view of a conventional elevator car having a well-known inspection box IB according to the prior art.

Preferably, the plug P and the sockets or jacks J are multipin circular connectors commercially available under AMP series 1 as set forth in AMP Catalog 82021 Revised August, 1995, pages 12, 21, 22. Each individual jack preferably contains only the pin connection associated with the circuit segment or branch to be bypassed by that jack. The other pin locations of that jack are empty so there is no possibility of miswiring a jack. According to an essential feature, only one plug unit is provided and it includes wires for each of the pins being used. When plugged into the normal socket (e.g., J5), the plug completes a feed from the inspection switch to the inspection relay (see FIG. 4). When the plug P is removed from the normal socket, the elevator is disabled and can be moved only by placing the car on inspection service from the top of car (e.g. FIG. 6) or from the machine room. The plug may then be inserted into an appropriate socket (or jack) to bypass the desired circuit segment or branch. To return a car to automatic operation, the plug is removed from the bypass socket and is reinserted into the normal socket. Thus, the arrangement according to the present invention assures that no safety device can be left bypassed when the elevator is returned to automatic operation.

While there has been shown and described what is presently considered a preferred embodiments of the present invention, it should be understood by those skilled in the art that various other changes, omissions and additions in the form and detail thereof may be made therein without departing from the spirit and scope of the invention.

What is claimed is:

1. An elevator safety checking apparatus, comprising:

a first group of electrical connectors mechanically bundled together to form a plug;

a plurality of second electrical connectors, each second connector disposed within one of a plurality of sockets, each socket adapted to receive said plug, each of the connectors of said first group making electrical connection with a corresponding connector of any one of said sockets when said plug is received by said one of said sockets; and a plurality of pairs of electrical connections, one connection of each pair extending from one of said connectors in said plug and the other connection of each pair extending from the corresponding one of said connectors in one of said sockets, a first one of said pairs completing a first branch circuit indicating normal operation when said plug is inserted into the related socket, each of the other ones of said pairs connected to opposite ends of related second branch circuits so as to shunt the related second branch circuit when said plug is inserted in the corresponding one of said sockets, each of said second branch circuits comprising an elevator control switch segment, whereby said plug cannot shunt one of said segments unless said plug is removed from said socket related to indicating normal operation.

2. An elevator safety checking apparatus according to claim 1 further comprising:

a controller connected to said first branch and to said second branches, and instructions stored within said controller, said instructions permitting only a speed of a car no greater than an inspection speed if said first branch circuit is open and one of said second branch circuits is shunted.

3. An elevator safety checking apparatus according to claim 1 wherein one of said segments comprises door switches.

4. An elevator safety checking apparatus according to claim 1 wherein one of said segments comprises gate switches.

5. An elevator safety checking apparatus according to claim 1 wherein one of said segments comprises safety chain switches.

* * * * *